US005964343A

United States Patent [19]

Steiner

[11] Patent Number: 5,964,343

[45] Date of Patent: Oct. 12, 1999

[54] CARRYING PLATE FOR BEVERAGE CANS

[75] Inventor: Alfred Steiner, Altmünster, Austria

[73] Assignee: Steiner Technology GmbH, Ebensee, Australia

[21] Appl. No.: 09/077,233

[22] PCT Filed: Nov. 27, 1996

[86] PCT No.: PCT/AT96/00235

§ 371 Date: May 26, 1998

§ 102(e) Date: May 26, 1998

[87] PCT Pub. No.: WO97/19866

PCT Pub. Date: Jun. 5, 1997

[30] Foreign Application Priority Data

Nov. 28, 1995 [AT] Austria ..... 645/95 U

[51] Int. Cl.[6] ..... B65D 21/02; B65D 75/00; B65D 1/36

[52] U.S. Cl. ..... 206/203; 206/427; 206/477; 206/560; 206/564

[58] Field of Search ..... 206/203, 427, 206/477, 480, 488, 560, 564; 220/509, 516

[56] References Cited

U.S. PATENT DOCUMENTS

| | | | |
|---|---|---|---|
| 2,411,673 | 11/1946 | Vechey, Jr. | 220/516 |
| 3,638,849 | 2/1972 | Goings | 206/564 X |
| 4,319,685 | 3/1982 | David | 206/427 X |
| 4,538,742 | 9/1985 | Prodel | 206/427 X |
| 4,615,444 | 10/1986 | de Larosiere | 206/427 |
| 4,664,255 | 5/1987 | Griffith | 206/477 X |
| 4,911,300 | 3/1990 | Colonna | 206/427 |
| 5,115,937 | 5/1992 | Chausse et al. . | |

FOREIGN PATENT DOCUMENTS

| | | | |
|---|---|---|---|
| 2248707 | 5/1975 | France | 206/427 |
| 9312895 U1 | 9/1994 | Germany . | |
| 4402177 A1 | 7/1995 | Germany . | |

*Primary Examiner*—Bryon P. Gehman
*Attorney, Agent, or Firm*—Alston & Bird LLP

[57] ABSTRACT

A carrying plate (1) for beverage cans (5) which have a seamless transition between base and casing is described, can receiving portions (2) being provided on the upper side of the plate with resilient holding devices (3) for the beverage cans (5) distributed over the perimeter and protruding from the upper side of the plate. In order to create advantageous construction conditions, it is proposed that the resilient holding devices (3) should form gripping jaws (4) for resiliently pressing in the casing of a can, and that the can receiving portions (2) should have, as well as these resilient holding devices, rigid axial guide webs (8) for the beverage cans (5) to be received.

14 Claims, 6 Drawing Sheets

CARRYING PLATE FOR BEVERAGE CANS

Figure 1:
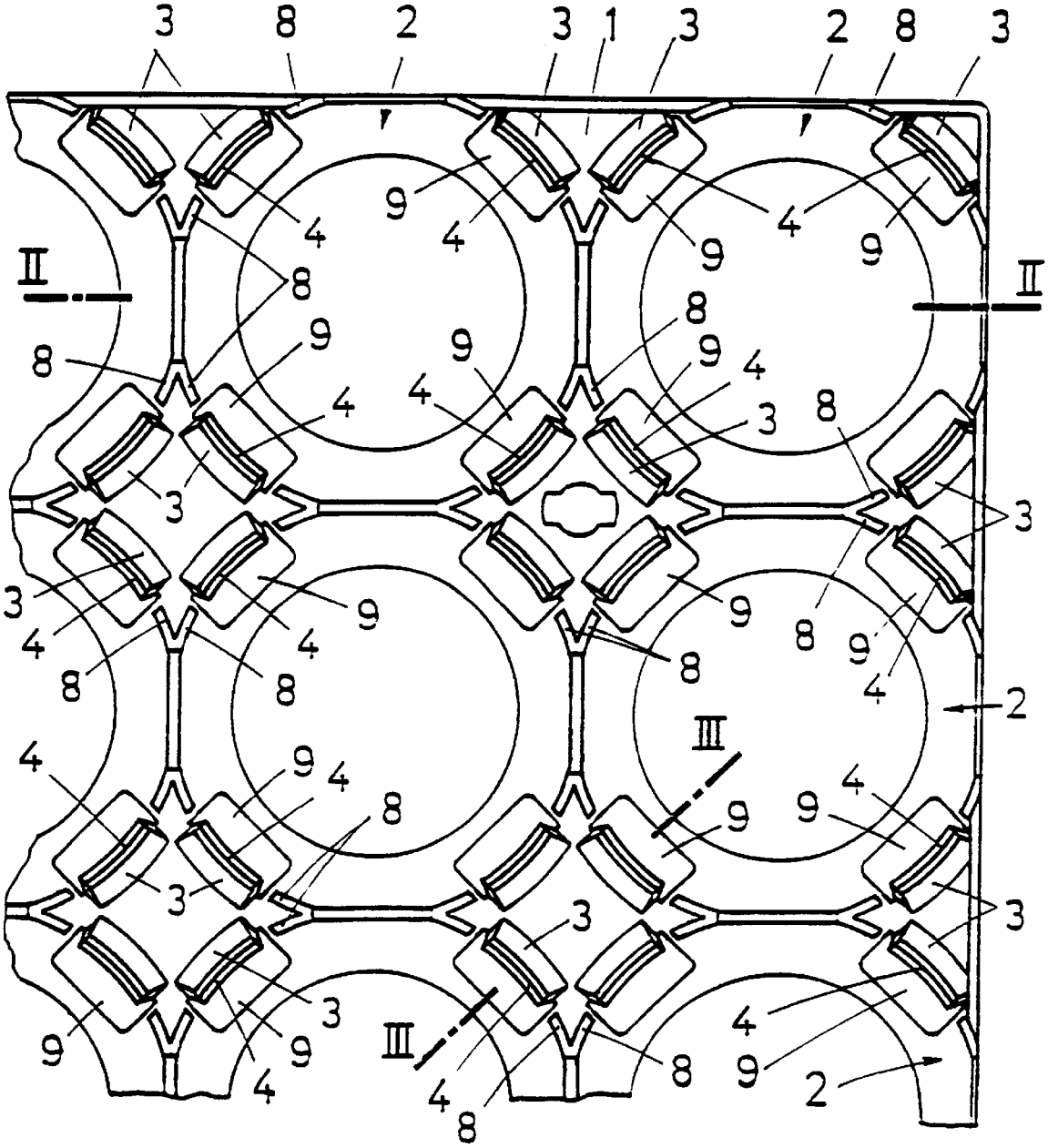

The invention relates to a carrying plate for beverage cans which have a seamless transition between base and casing, can receiving means being provided on the upper side of the plate with resilient holding devices for the beverage cans distributed over the perimeter and protruding from the upper side of the plates.

Beverage cans are normally packed in self-supporting containers or in box-like receiving bases and this has advantages for the transport and storage of goods of this kind. Packing in self-supporting containers requires not only comparatively expensive receptacles but also necessitates the same storage volume for the full and the empty receptacles. By using box-like receiving bases in which the beverage cans are held securely, for example with the aid of shrink-films, this disadvantage can admittedly be avoided, however problems arise with stacking up the individual storage units on top of one other because it is scarcely possible to prevent lateral displacement of the stacked storage units. As an advantageous way of forming the stack, the method is already known (WO 92/16430) of inserting carrying plates both on the upper side and on the underside with centering devices for receiving canned goods, such that, in order to form a pile of canned goods with a base area stretching over a plurality of carrying plates, the carrying plates provided between the individual layers of the stack can be disposed offset in relation to the carrying plates of the adjacent layers, at least in groups. The centering devices for the lower end faces of the canned goods on the upper side of the carrying plate guarantee that the individual canned goods are received without slipping, the centering devices for the upper end faces of the cans on the underside of the carrying plates creating the possibility of stacking the storage units determined by the carrying plates the one above the other without having to fear any lateral displacement of the individual layers in relation to one another. In order to obtain packaging units which may be handled easily, the carrying plates can have a connecting device for a carrying handle provided with at least one holding down device for the canned goods. These packaging units, however, require an additional carrying handle which has to be taken away again in order to form the stack.

Finally a method is known (U.S. Pat. No. 4,120,396) of providing in the region of the receiving means for the cans of a carrying plate resilient holding devices protruding from same in the form of snap-in hooks which overlap the undercut can edge like a snap-on cover. This produces a simple connection between the carrying plate and the beverage cans received by it, but this pre-supposes beverage cans with a base which protrudes radially in relation to the can casing. Since this presumption cannot, however, be made with the traditional and generally deep-drawn beverage cans with a seamless transition between casing and base, carrying plates of this kind are not suitable for receiving these beverage cans which are seamless in their base region.

Thus the purpose underlying the invention is to create a carrying plate for beverage cans which have a seamless transition between base and casing, it being possible to guarantee that there will be sufficient cohesion between the carrying plate and the beverage cans for normal handling.

Proceeding from a carrying plate of the type depicted initially, the invention fulfils the required purpose in that the resilient holding devices form gripping jaws for resiliently pressing in the casing of the cans, and in that the can receiving means have, as well as these resilient holding devices, rigid axial guide webs for the beverage cans which are to be received.

When a beverage can is inserted into a can receiving means of the carrying plate, the gripping jaws of the resilient holding devices are resiliently pressed away from one another by the base of the can, which, because of the transition into the casing, is stiff in the edge region, until they come into contact with the can casing above this transitional region and press in said casing resiliently, such that the beverage cans are held between the gripping jaws of the resilient holding devices not only by frictional engagement but also as a form fit. Nevertheless, this clamping could be involuntarily overcome by the beverage cans tipping. In order to prevent the beverage cans from becoming free from the receiving means of the carrying plate as a result of a tilting moment on the cans, additional axial guide webs for the beverage cans are provided which are configured sufficiently rigid to prevent any tipping of the beverage cans. Through the co-operation of the resilient gripping jaws and the rigid guide webs, the received beverage cans can thus only be pulled in an axial direction out of the can receiving means, it being necessary not only for the friction between the gripping jaws and the can casing to be overcome but also the spring force of the gripping jaws, in order to be ale to take out of the gripping jaws the beverage can which has this stiffer transition between the base and the casing in relation to the remaining casing of the can.

If the resilient holding devices are taller than the axial guide webs, there being provided, on the inner side of the holding devices inclined inwards, entry holes in the carrying plate which have a minimum diameter corresponding to the diameter of the gripping jaws, there arise particularly advantageous stacking conditions for these carrying plates because, when the carrying plates are placed on top of one another, the resilient holding devices penetrate through the entry holes of the respectively upper carrying plate and come to rest on the inner side of the holding devices of the upper carrying plate, which brings about mutual alignment of the carrying plates. The axial guide webs must, however, be set back in height in relation to the holding devices because these guide webs determine the distance between the stacked carrying plates.

Particularly simple construction conditions can be achieved, where the can receiving means are disposed in rows, by providing the axial guide webs respectively in the gusset region between two abutting can receiving means and connected to one another in pairs. This form of embodiment offers not only a space-saving arrangement of the can receiving means but also, on account of the mutual connection of the guide webs of adjacent can receiving means, ensures a sufficient flexural strength of the guide webs with comparatively small wall thicknesses.

In addition, it is possible for the underside of the carrying plate to have protruding guide webs running concentrically with the mid-point and forming a receiving means between themselves, by means of which radial guiding of the inserted beverage cans or centering is guaranteed when the beverage cans are inserted.

Provision is, however, also made for the guide webs forming the receiving means to run towards one another in their end regions at an angle, in the form of connecting webs, and to be connected as one piece with adjoining supporting webs, whereby a receiving means for the guide element is guaranteed which is secured against slipping and in addition the flexural strength of the whole carrying plate is increased.

Furthermore, it is advantageous if the guide webs arranged in pairs are connected via a connecting web connected as one piece with the base, and by this means the flexural strength of the guide webs is increased.

In addition it is also possible for the guide webs to be formed by a V-shaped profile running perpendicular to the base and connected with same as one piece, by which means a form of the guide webs adapted to the geometrical form of the receiving means is achieved and thus any relative movement of carrying plates stacked up on one another is avoided.

In addition, it is advantageous if one surface of the guide webs forms a bearing surface for an inner surface of the receiving means, because in this way the snug fit of a second carrying plate placed on to a first carrying plate is achieved.

According to a further form of embodiment, provision is made for the gripping jaws or holding arms projecting over the one upper side of the can receiving means to be aligned at an angle of approximately 90° to the upper side, and by this means the demoulding process during the manufacture of the carrying plate is made substantially easier.

However, it is also possible for the holding arms to be configured tapering upwards towards one another, by which means the deforming power of the holding arms can be reduced when it is applied to a beverage can in the can receiving means.

It is in addition advantageous with this design if the holding arms have, in an upper end region, gripping beads protruding in the direction of the can receiving means, and this guarantees the gripping or fixing of the beverage cans in the can receiving means.

In addition, it is advantageous if the underside of the carrying plate is provided in the region of the holding arms with a groove-shaped moulded indentation, by which means it becomes possible for the holding arm of a lower carrying plate to engage in this groove-shaped moulded indentation and the stack height of a number of empty carrying plates stacked on top of one another can be reduced.

In addition, it is also possible for the region which has the gripping jaws, or an underside of a web, to be arranged at a distance offset in relation to an underside of a can receiving means, and this likewise makes it possible to achieve an advantageous reduction in the height of the stack of a plurality of carrying plates on top of one another.

Furthermore, it is advantageous if the region with the holding arms is connected as one piece with the can receiving means via the portion of the base forming the moulded indentation, and this substantially increases the flexural strength of the whole carrying plate.

The subject matter of the invention is represented in the drawings by way of example.

Figure 2:
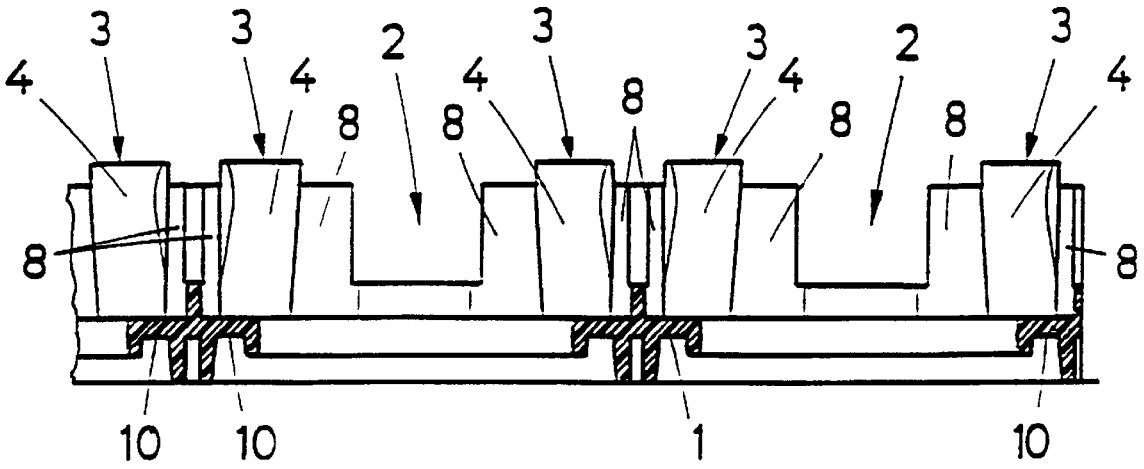
Figure 3:
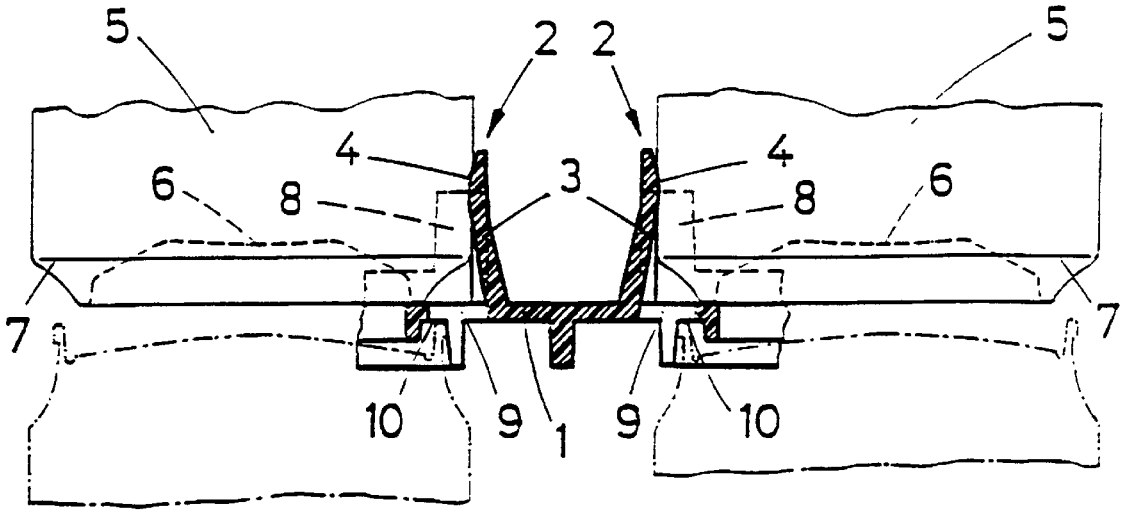
Figure 4:
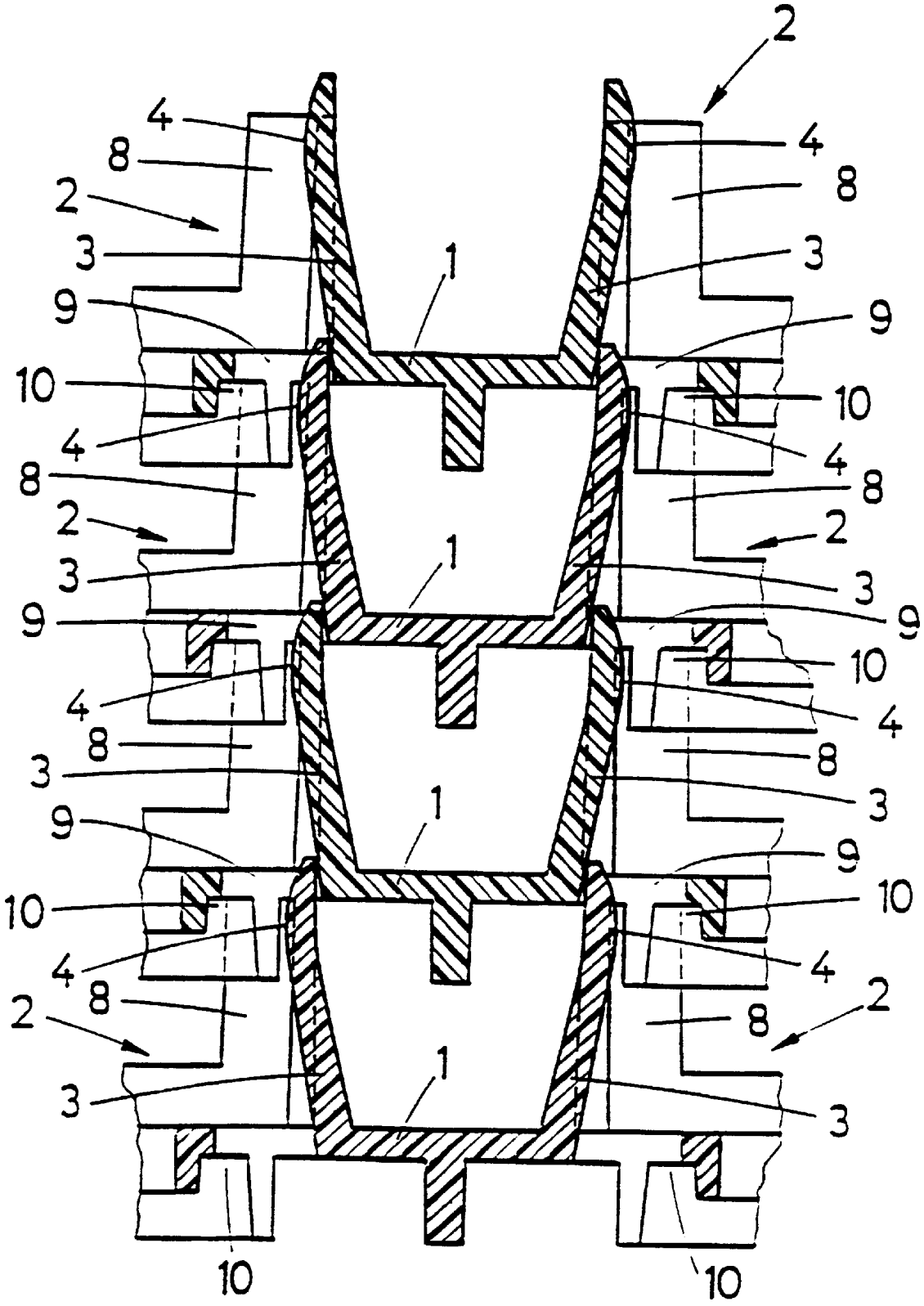
Figure 5:
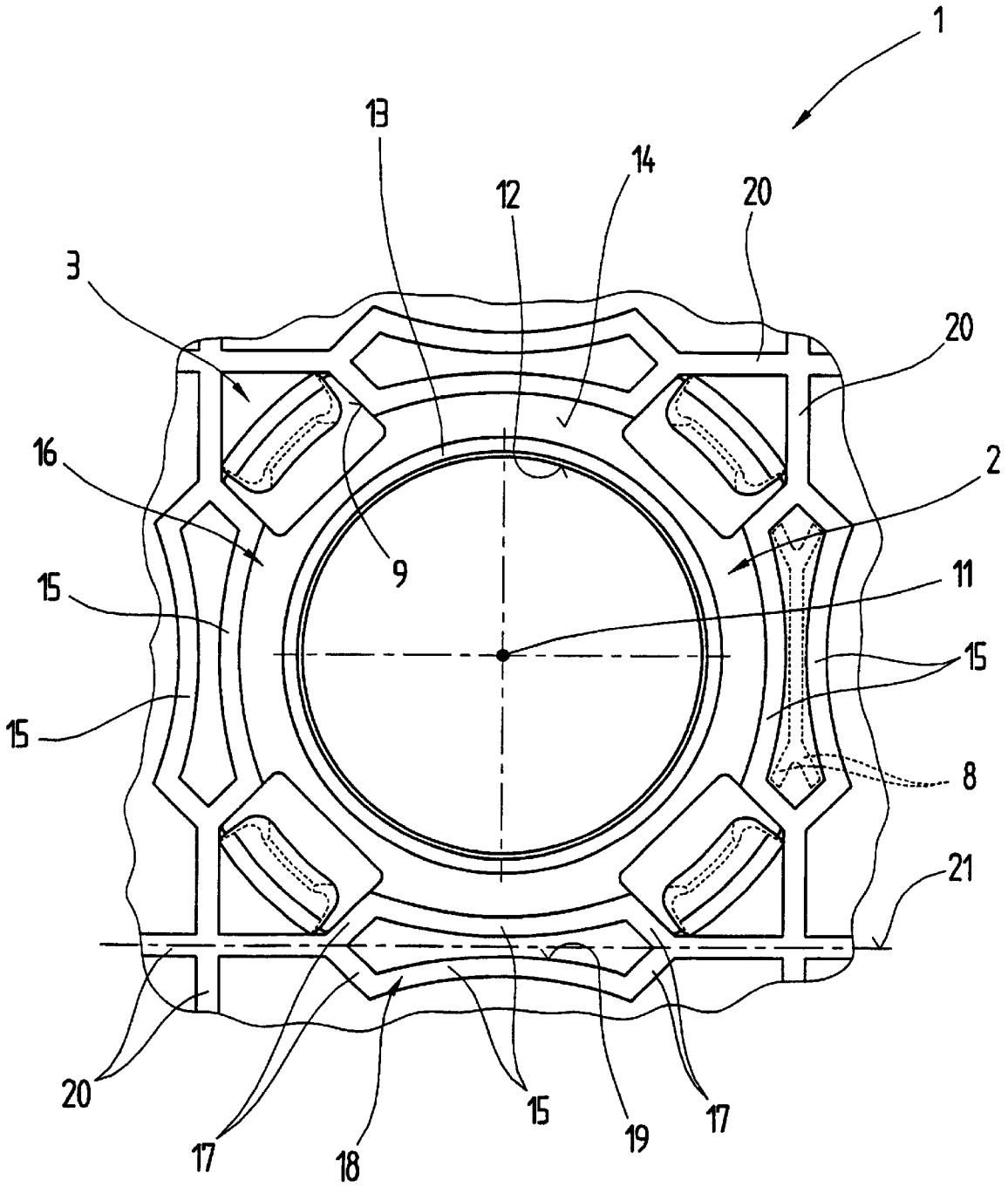
Figure 6:
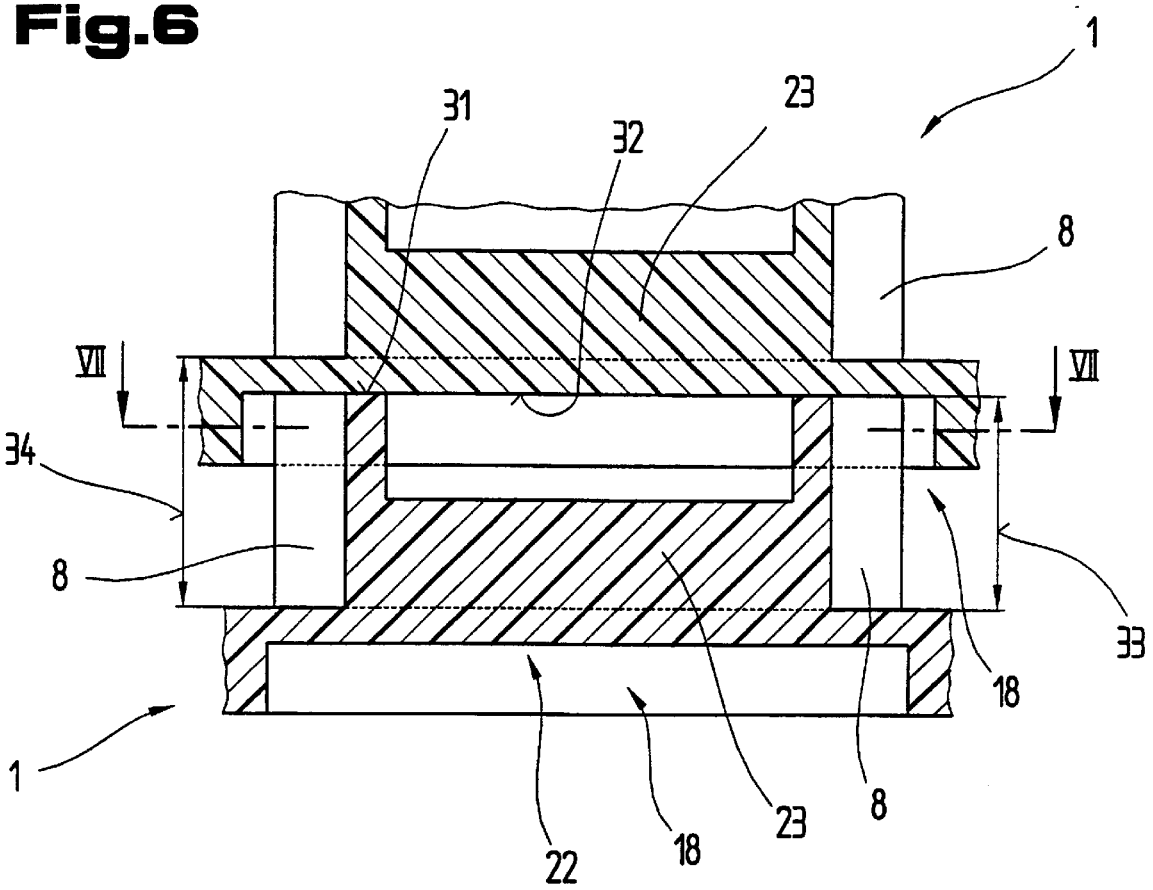
Figure 7:
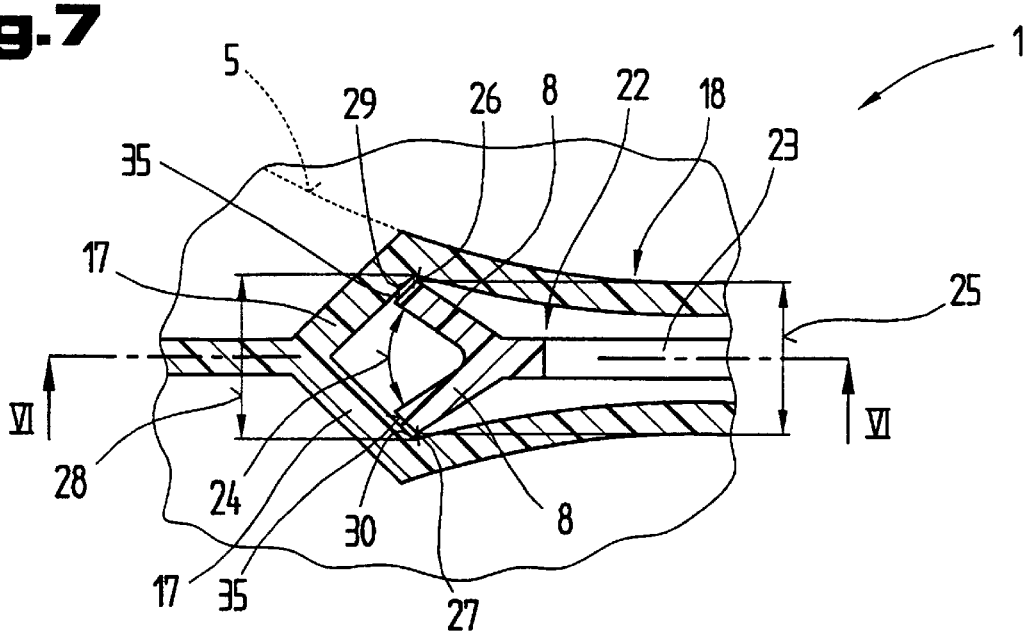
Figure 8:
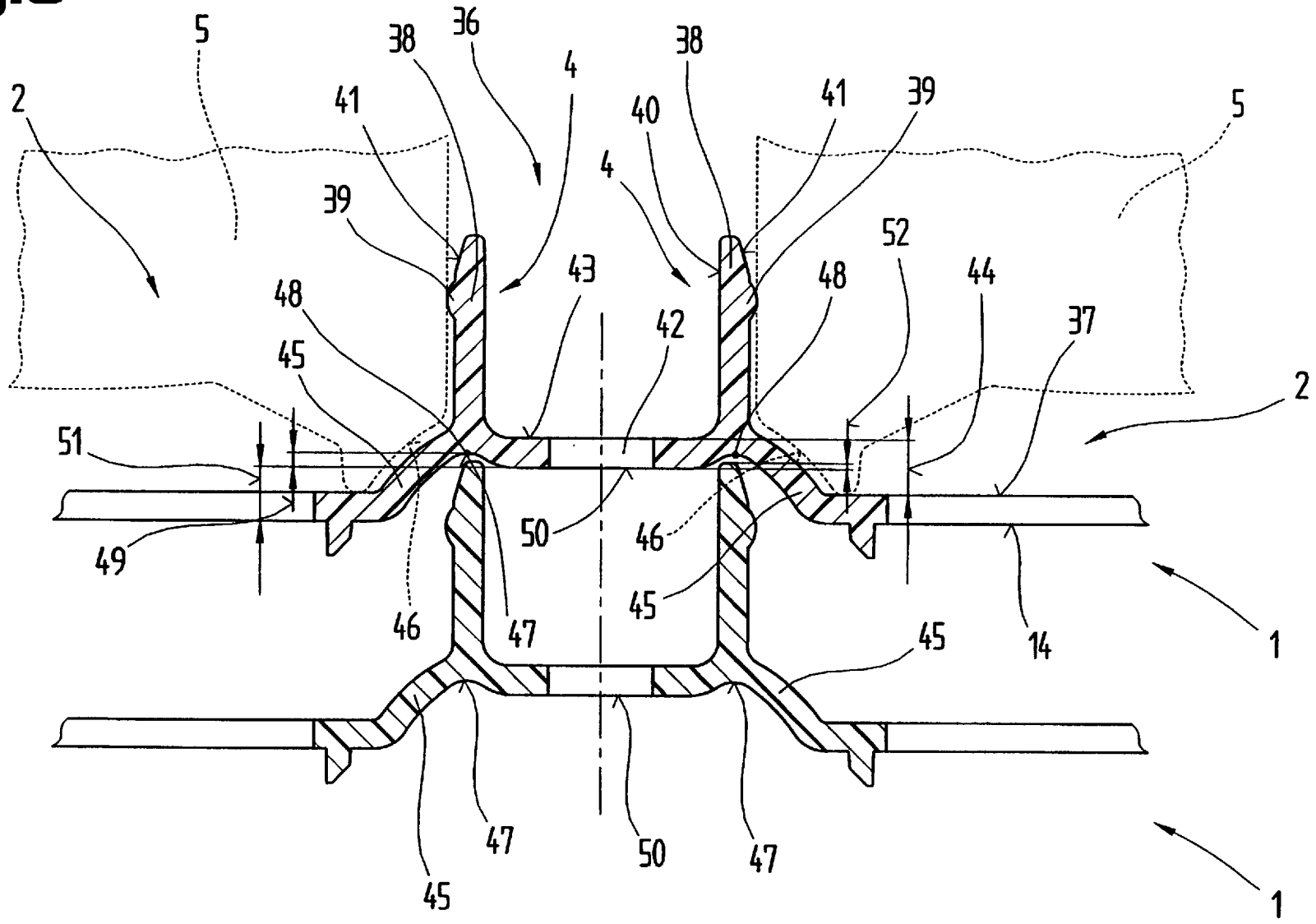

The figures show:

FIG. 1 a carrying plate according to the invention for beverage cans in a simplified plan view;

FIG. 2 a section along line II—II of FIG. 1, on an enlarged scale;

FIG. 3 a section along line III—III of FIG. 1, on an enlarged scale;

FIG. 4 a section corresponding to FIG. 3 through a plurality of carrying plates stacked on top of one another, on an enlarged scale;

FIG. 5 the carrying plate according to the invention for beverage cans, seen from below;

FIG. 6 a partial region, including guide webs, of the carrying plate according to the invention, cut in a side view, as per lines VI—VI in FIG. 7;

FIG. 7 the partial region according to FIG. 6, in section, as per lines VII—VII in FIG. 6;

FIG. 8 a further form of embodiment of the holding devices of the carrying plate according to the invention, in section in side view, in simplified, schematic representation.

First of all it should be noted that in the differently described forms of embodiment the same parts are given the same reference numbers or the same component names, the disclosures contained in the whole specification being able to be transferred by analogy to the same parts with the same reference numbers or the same component names. Moreover, individual features from the different forms of embodiment given by way of example and shown here, can also represent on their own independent solutions according to the invention.

The carrying plate 1 according to the embodiment, given by way of example and shown here, has can receiving means 2 arranged in longitudinal and transverse rows, over the perimeter of which are distributed resilient holding devices 3. These holding devices 3, inclined inwards in relation to the can receiving means 2, form gripping jaws 4 for the beverage cans 5 which are to be received, as indicated with a thin line in FIG. 3. The arrangement is such that the gripping jaws resiliently press in the casing of the can, with the result that the beverage cans held between the gripping jaws 4 can only be removed from the can receiving means 2 if not only the friction between the gripping jaws 4 and the can casing, but also the spring force of the gripping jaws 4 is overcome. In this connection it must be remembered that, because of the transition between the base 6 and the casing of the beverage cans 5, the transitional region 7 is stiffer than the casing, such that the gripping jaws 4 have to be pressed away from one another by this stiffened transitional region 7 both when the beverage cans 5 are being inserted and when they are being taken out.

In addition to the resilient holding devices 3, the can receiving means 2 are provided with rigid axial guide webs 8 which effectively prevent the beverage cans 5 from tipping round a transverse axis. As a result of these measures, the beverage cans 5 can only be taken out of the can receiving means 2 in an axial direction, and this prevents any by-passing of the gripping connection between the carrying plate 1 and the beverage cans 5 through tipping of the cans. As can be taken from FIG. 1, the axial guide webs 8 are located in the gusset region between the can receiving means 2 disposed in rows, the guide webs 8 being connected to one another in pairs in order to achieve greater flexural strength with low material outlay.

On the inner side of the holding devices 3 which are inclined inwards, entry holes 9 are provided in the carrying plate 1, which have a minimum diameter corresponding to the diameter of the gripping jaws 4. Since, in addition to this, the height of the resilient holding devices 3 exceeds that of the guide webs 8, advantageous stacking conditions are produced for carrying plates 1 of this kind, as can be seen from FIG. 4. When the carrying plates are stacked, the gripping jaws 4 of the respectively lower carrying plates engage namely in the entry holes 9 of the respectively upper carrying plates, such that there is mutual alignment between the carrying plates as a result of the holding devices 3 engaging in one another. The shorter height of the axial guide webs 8 ensures here that the gripping jaws 4 engage in the entry holes 9 of the respectively directly superposed carrying plate because the height of the guide webs 8 determines the mutual spacing of the carrying plates 1 from one another.

As can be seen specially from FIG. 2, the carrying plate 1 can also be provided on its underside with centering devices 10 for receiving the drink cans 5 in the lid region, in order to be able to stack up the carrying plates 1 loaded with the beverage cans 5 so that they do not slip. To this end, the carrying plates 1 only need to be so placed on the beverage cans held securely in similar carrying plates that the beverage cans 5 engage with their top edge in the centering devices 10 on the underside of the carrying plate 1, as is indicated in FIG. 3.

In FIG. 5 a portion of the carrying plate 1 according to the invention, especially a single can receiving means 2, is represented in a view from below.

Around a mid-point 11, a circular opening 12 is disposed with which a centering web 13 connects in direct transition. An underside 14 of the can receiving means 2 connects with this centering web 13 and extends radially around the mid-point 11 in the direction of guide webs 15 running concentrically with the mid-point 11. On this underside 14 of the can receiving means 2, the already mentioned entry holes 9 are arranged through which the penetration of the holding devices 3 through the underside 14, when a plurality of carrying plates are stacked on top of one another, is made possible.

If this carrying plate 1 or the can receiving means 2 is placed with its underside on a beverage can, the circular edge, located in the upper region of the beverage can and projecting beyond it, engages in a circular holding indentation 16 and is held in this position by the guide webs 15 or by the centering web 13, and by this means lateral slipping of the superposed carrying plate 1 is securely avoided.

In addition, the guide web 15 is connected with a further guide web 15, which is associated with the adjacent can receiving means 2, via connecting webs 17, whereby a receiving means 18 is formed, delimited by webs, and which has an inner border 19. The receiving means 18 are in turn connected to one another by supporting webs 20, and by this means increased flexural strength of the carrying plate 1 can be achieved. Moreover, the centering web 13 can have slight shaped bevels on the side facing the entry hole 9 or the guide webs 15 can have slightly shaped bevels on the side facing the mid-point 11, in order to achieve in this way centering of a carrying plate 1 placed on the beverage cans.

The guide webs 15 are adapted in their curvature to the outer contour of the beverage can in order to guarantee secured stacking up of the carrying plates 1 filled with beverage cans. Connected with this circumstance is the fact that the second guide web 15, which is associated with the adjacent can receiving means 2, is a mirror image around a longitudinal centre line 21 of the supporting webs 20. The receiving means 18 are configured in such a way that their geometric shape makes it possible to receive the guide webs 8, slight bevelling along the inner border 19 of the receiving means 18 being possibly of advantage for the centred deposition of a second carrying plate 1.

In FIGS. 6 and 7 the guide webs 8 ar e shown in their inserted form in a receiving means 18.

As can be better seen from FIG. 7, the guide webs 15 run in a shape adapted to the beverage cans 5 and then pass over into the connecting webs 17 in the form running at an angle to the support webs 20, by which means the geometrical form of the receiving means 18 is produced. A guide element 22, which engages with the receiving means 18, now consists of four guide webs 8 running at an angle to a connecting web 23 and connected to same as one piece.

Two guide webs 8 disposed in a V-shape in relation to one another and perpendicular to an underside of the carrying plate 1 enclose an acute angle 24 of preferably less than 90°, a distance 25 between outer edges 26, 27 of the guide webs 8 and a distance 28 between the inner edges 29, 30 of the receiving means 18 being of the same size or slightly smaller, in order to guarantee a reliable or guided introduction of the guide element 22 into the receiving means 18. Through this advantageous configuration, moreover, effective securing against lateral slipping in each direction of two or more carrying plates 1 stacked on top of one another is achieved.

As can be better seen from FIG. 6, one surface 31 of the guide element 22 comes into contact with an inner surface 32 of the receiving means 18, by which means the snug fit of a second carrying plate 1 placed on to a first carrying plate 1 is achieved over its full extent. In addition the guide element 22 has a height measured in the direction of the receiving means 18 of a second carrying plate 1, which is decisive for the spacing of two carrying plates 1 stacked on top of one another. Through an alteration in this height 33, the spacing 34 between two carrying plates 1 can be influenced, and by this means different stack heights of a plurality of carrying plates 1 can be achieved. In addition, the penetration height of the holding devices 3 through the entry holes 9 can likewise be influenced by differing heights 33.

This arrangement of guide elements 22 and receiving means 18 not only proves advantageous in the stacked state of the carrying plates 1, but also makes possible radial fixing of the cans when they are inserted. The guide element 22, which in the stacked state protrudes into the receiving means 18, serves as a radial fixing device when the beverage can is inserted, which prevents any unwanted slipping or falling over of the beverage can and in this way secure stacking of loaded carrying plates 1 is made possible.

In order that, when two or more carrying plates are stacked on top of one other, no twisting or tilting is caused as the guide element 22 engages in the receiving means 18, it is advantageous if end faces 35 of the guide webs 8 are at a small distance from the inner edge 19 of the receiving means 18 in the region of the connecting webs 17. Thus it is likewise assumed that only horizontal stacking or de-stacking of the carrying plates 1 is possible, and indirectly because of this also, the buckling over of a relatively tall pile of carrying plates 1 is avoided.

In FIG. 8 a region 36 of the carrying plate 1 which has the gripping jaws 4 is shown on two carrying plates 1 stacked on top of one another.

This region 36 generally includes four gripping jaws 4, one gripping jaw 4 being associated with each adjacent can receiving means 2. The gripping jaw 4 consists of holding arms 38 running perpendicular to an upper side 37 lying opposite the underside 14, a gripping bead 39 being disposed on the side of the holding arms 38 facing the beverage cans 5. It is naturally also possible for the holding arms 38 to be configured tapering towards one another in an opposite direction to the can receiving means 2. One holding arm 38 is configured in such a way that, on the end region of the holding arm 38 which faces the beverage can 5, there is disposed a slanting face 41 which runs at an angle from gripping bead 39 in the direction of the surfaces 40 of the holding arm 38 which lie opposite gripping bead 38, and thus, when a beverage can 5 is inserted into the can receiving means 2, this makes it possible for the holding arm 38 to be deformed along the slanting face 41.

Since the holding arms 38 are configured resiliently flexible, when a beverage can 5 is inserted into the can receiving means 2, they are pushed radially towards the outside and thus make it possible for a beverage can 5 to be guided into the can receiving means 2. Through deformation of this kind of the holding arms 38 or of the gripping jaws 4, initial tension is produced in same which effects exact centering of the beverage can 5, in its inserted position, in the can receiving means 2 and holds it clamped.

Furthermore, tipping of the beverage can 5 in the can receiving means 2 is reliably avoided.

The four gripping jaws 4 disposed in one region 36 are connected to one another as one piece via a web 42, an upper side 43 of the web 42 standing at a distance 44 above the upper side 37 of the can receiving means 2. This web 42 or the gripping jaws 4 are then connected as one piece with the can receiving means 2 via a portion 45 of the base running at an angle in the direction of the upper side 37 of the can receiving means 2. With this advantageous design, it is possible to dispense with the entry holes 9, as described in detail before, and thus greater stability of the carrying plate 1 is achieved. This base portion 45 is adapted in its geometric form to an outer surface 46 which is disposed in the base region of the beverage can 5. Through this advantageous design of the base portion 45 it is possible to arrange a moulded indentation 47 in the transitional region of the web 42 with the base portion 45, without any weakened region in the material of the carrying plate 1 being produced, one vertex 48 of this moulded indentation 47 being at a distance 49 from an underside 50 of the web 42.

In order to keep the stack height of carrying plates 1 as small as possible when a plurality of empty carrying plates 1 is piled on top of one another, the gripping jaws 4 of the lower carrying plate 1 now engage with the moulded indentation 47 of the carrying plate 1 placed thereon or protrude beyond the underside 50 of the web 42. The stack height of a plurality of carrying plates 1 is likewise positively influenced by a distance 51 between the underside 14 of the can receiving means 2 and the underside 50 of the web 42, since the stacked height of two carrying plates 1 placed on top of one another is reduced by the amount of this distance 51. A depth of engagement 52 of the gripping jaws 4 in the moulded indentation 47 can be the same as, or if necessary slightly smaller than, distance 49.

Finally, it should be pointed out that in the embodiments, given by way of example and described above, individual parts were shown disproportionately enlarged in order to improve understanding of the solution according to the invention. Furthermore, individual parts of the previously described combinations of features of the individual embodiments, given by way of example, may form independent solutions according to the invention in conjunction with other individual features from other embodiments, given by way of example.

Above all, the individual embodiments shown can form the subject matter of independent solutions according to the invention. The problems and solutions relating thereto can be taken from the detailed descriptions of these figures.

List of Reference Numbers

1 Carrying plate
2 Can receiving means
3 Holding device
4 Gripping jaw
5 Beverage can
6 Base
7 Transitional region
8 Guide web
9 Entry hole
10 Centering device
11 Mid-point
12 Opening
13 Centering web
14 Underside
15 Guide web
16 Holding indentation
17 Connecting web
18 Receiving means
19 Border
20 Supporting web
21 Longitudinal centre line
22 Guide element
23 Connecting web
24 Angle
25 Distance
26 Outer edge
27 Outer edge
28 Distance
29 Inner edge
30 Inner edge
31 Surface
32 Surface
33 Height
34 Spacing
35 End face
36 Region
37 Upper side
38 Holding arm
39 Gripping bead
40 Face
41 Face
42 Web
43 Upper side
44 Height
45 Base portion
46 Outer surface
47 Moulded indentation
48 Vertex
49 Distance
50 Underside
51 Distance
52 Depth of engagement

I claim:

1. Carrying plate for beverage cans which have a seamless transition between base and casing, the carrying plate having an upper side and can receiving means being provided on the upper side of the plate, each can receiving means having a perimeter and including resilient holding devices for the beverage cans distributed over the perimeter and protruding from the upper side of the plate, characterised in that the resilient holding devices form gripping jaws resiliently to press in the casing of a can, and in that the can receiving means have rigid axial guide webs for the beverage cans to be received.

2. Carrying plate according to claim 1, characterised in that the axial guide webs are exceeded in height by the resilient holding devices which are inclined inwards toward a mid-point of each respective can receiving means, and wherein the carrying plate defines entry holes therein located on inner sides of the holding devices and being shaped to permit receipt into the entry holes of the gripping jaws of another carrying plate.

3. Carrying plate according to claim 1, characterised in that the can receiving means are arranged in rows, the carrying plate defining gusset regions between abutting pairs of can receiving means, and the axial guide webs being provided in the gusset regions between abutting can receiving means.

4. Carrying plate according to claim 1, characterised in that an underside of the carrying plate has protruding guide webs which extend concentrically about a mid-point of each can receiving means and form receiving means for receiving upper ends of beverage cans to facilitate stacking the carrying plate upon another carrying plate that contains cans.

5. Carrying plate according to claim 4, characterised in that the receiving means on the underside of the carrying plate are arranged in rows, the guide webs of abutting receiving means on the underside having end regions that extend towards one another and are connected as one piece with adjoining supporting webs.

6. Carrying plate according to claim 1, characterised in that the guide webs on the upper side of the carrying plate define bearing surfaces for inner surfaces of the receiving means formed on the underside of the carrying plate.

7. Carrying plate according to claim 1, characterised in that the guide webs are disposed in pairs and are connected via a connecting web which is connected as one piece with a base of the carrying plate.

8. Carrying plate according to claim 1, characterised in that the guide webs have a V-shaped profile and extend perpendicular to a base of the carrying plate and are connected to the base as one piece.

9. Carrying plate according to claim 1, characterised in that the gripping jaws protruding beyond one upper side of the can receiving means are aligned at an angle of approximately 90° to the upper side of the can receiving means.

10. Carrying plate according to claim 1, characterised in that the gripping jaws of each can receiving means are configured tapering upwards towards one another.

11. Carrying plate according to claim 1, characterised in that the gripping jaws having gripping beads projecting in an upper end region in the direction of the can receiving means.

12. Carrying plate according to claim 1, characterised in that an underside of the carrying plate is provided in the region of the gripping jaws with a groove-shaped moulded indentation.

13. Carrying plate according to claim 1, characterised in that a region having the gripping jaws is arranged offset in relation to an underside of a can receiving means by a vertical distance.

14. Carrying plate according to claim 1, characterised in that a region with the gripping jaws is connected as one piece with the can receiving means via a base portion, the base portion having a moulded indentation formed in an underside thereof for receiving upper ends of the gripping jaws of another carrying plate upon which the carrying plate is stacked.

* * * * *

UNITED STATES PATENT AND TRADEMARK OFFICE

CERTIFICATE OF CORRECTION

PATENT NO. : 5,964,343

DATED : October 12, 1999

INVENTOR(S) : Steiner

It is certified that error appears in the above-identified patent and that said Letters Patent is hereby corrected as shown below:

Title page, item [73], in the Assignee's address, "Australia" should read --Austria--.

Column 9, line 7, "claim 1" should read --claim 4--.

Signed and Sealed this

Fourth Day of April, 2000

*Attest:*

*Attesting Officer*

Q. TODD DICKINSON

*Director of Patents and Trademarks*